United States Patent [19]

Lewin

[11] 4,059,754

[45] Nov. 22, 1977

[54] LOUVER FOR LIGHT DISTRIBUTION

[75] Inventor: Ian Lewin, Scottsdale, Ariz.

[73] Assignee: American Louver Company, Skokie, Ill.

[21] Appl. No.: 648,036

[22] Filed: Jan. 12, 1976

[51] Int. Cl.[2] ..... F21S 1/06

[52] U.S. Cl. ..... 362/217; 362/342

[58] Field of Search ..... 240/102 B, 103 B, 102 A, 240/102 R, 51.11 R, 78 LF, 78 LK, 78 LD, 9 R, 103 R, 106 R

[56] References Cited

U.S. PATENT DOCUMENTS

| | | | |
|---|---|---|---|
| 2,874,271 | 2/1959 | Lipscomb | 240/51.11 R |
| 3,246,138 | 4/1966 | Florence | 240/51.11 R |
| 3,291,978 | 12/1966 | Greenberg et al. | 240/9 R X |
| 3,798,443 | 3/1974 | Bartenbach | 240/78 LK X |

*Primary Examiner*—Donald A. Griffin

*Attorney, Agent, or Firm*—Hume, Clement, Brinks, Willian & Olds, Ltd.

[57] ABSTRACT

A louver unit for a lighting fixture assembly wherein blades extending longitudinally of the axis of an elongated lamp have reflective side surfaces curved on a relatively smaller radius and blades extending perpendicular to said elongated lamp have corresponding surfaces curved on a relatively greater radius. This produces an output of light in the longitudinal plane more nearly equal to that in the transverse plane.

4 Claims, 6 Drawing Figures

LOUVER FOR LIGHT DISTRIBUTION

FIELD OF THE INVENTION

This invention is in the field of lighting. It relates particularly to optical devices employed to screen discomfort glare light from lighting fixtures.

BACKGROUND OF THE INVENTION

Glare light from a ceiling-mounted fixture, for example, is that which is emitted at angles close to the horizontal and which passes across the room and strikes the viewer's eyes, producing the sensation of glare. The light which creates such glare provides little useful light for any visual task being performed by the viewer. As a result, it is conventional to control the emission of light by screening means to restrict the output of light rays at angles close to the horizontal.

In the design of such screening means, it is desirable to absorb as little light as possible. Preferred designs redirect light rays traveling at high angles to lower angles where they emerge to form useful light beneath the lighting fixture.

Louver panels of various forms are frequently used as screening means and are well known in the art. They are normally placed beneath the lighting fixture to provide the desired screening.

One class of louver unit construction which is known performs the aforedescribed light redirection function by the use of curved surfaces formed on the sides of the louver blades and coated with specular aluminum. These blade surfaces intercept light rays emitted at a relatively high angle from the vertical and redirect them at a lower angle; i.e., more toward the vertical. As a result, the useful effect of the light rays is increased.

This type of louver unit is effective and has many advantages. However, it does have shortcomings in the area of uniform light distribution and appearance where non-symmetrical light fixtures are employed; i.e., elongated fluorescent fixtures, for example.

SUMMARY OF THE INVENTION

It is an object of the present invention to provide an improved louver unit of the type employing curved surface louver blades to redirect light rays traveling at high angles to the vertical. It is another object to provide a louver unit wherein the appearance of the light system as a whole is similar whether viewed in a transverse or longitudinal plane. It is still another object to provide an increased open cell area in the louver unit whereby useful light output is increased. A further object is to provide a maximum luminaire (louver unit and housing) spacing to mounting height ratio; one which is superior to known systems. It is still a further object to provide a louver unit wherein the blade design is such that a reduced amount of plastic material is required.

The foregoing and other objects are realized in accord with the present invention by providing a louver unit wherein a larger radius of curvature is employed on the curves of the louver blades for the transverse blades than is employed on the longitudinal blades. Light rays traveling transversely of the fluorescent light tube, for example, strike the longitudinal blades having a relatively small radius of curvature. As a result, the high intensity light normally obtained in transverse radiation from the tube is reflected at a relatively lower angle to the vertical. More useful light results and less glare is seen by a person standing at some distance horizontally from the louvered area in question. On the other hand, light emitted in rays longitudinally of the fluorescent tubes is not of such high intensity as the angle of the viewer increases from the vertical. Accordingly, the transverse louver blades have a larger radius of curvature. The light rays proceeding longitudinally from the lamp are reflected at a greater angle to the vertical.

Accordingly, the appearance of lighting fixtures equipped with the invention is similar whether viewed from the transverse or longitudinal planes. This gives an improved appearance in the lighting installation where lighting fixtures are viewed in both transverse and longitudinal planes.

In addition, the open area at the top of each louver cell is larger than found in prior art louver designs. Accordingly, the open cell area and therefor the useful light area is increased. Furthermore, the total cross-sectional area of the louver blades is reduced, resulting from the use of a longer radius on one axis. Thus, a reduced amount of plastic material is required for the construction of the louver unit in the present invention.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENT

Figure 1:
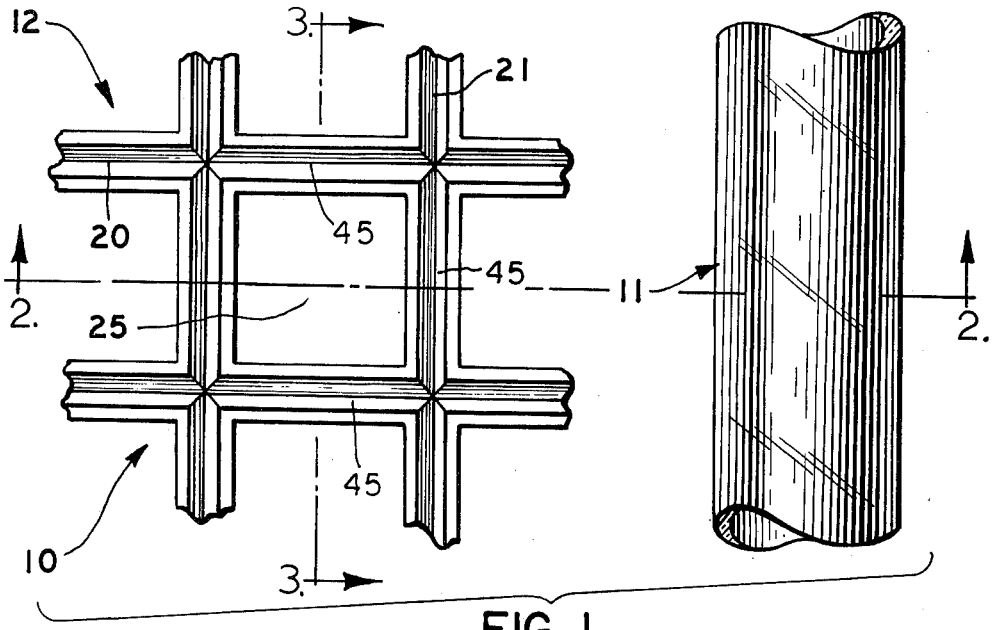
FIG. 1 is a plan view of a portion of a louver unit and lighting fixture assembly embodying features of the present invention.

Referring now to the drawings, and particularly to FIG. 1, a portion of a louver unit embodying features of the present invention is seen generally at 10, in plan view. The louver unit 10 is seen from the top, looking down on an elongated fluorescent lamp tube 11 which surmounts the louver unit 10 in a lighting assembly generally designated 12.

The louver unit 10 is suspended in a ceiling grid in a well-known manner. The fluorescent lamp tube 11 is suspended in a conventional manner. Only one of the lamp tubes 11 is shown, but it will be understood that a lighting assembly 12 would normally contain several of these tubes extending parallel each other above a louver unit in a single ceiling panel.

The louver unit 10 is, in the present invention, molded of plastic in one piece and includes longitudinally extending blades 21 disposed perpendicular to transversely extending blades 20. The blades 20 and 21 are spaced 1½ inches apart on their center lines in both longitudinal and transverse directions. They form, between them, a series of openings or "cells" 25 through which light passes downwardly from the lamp tube 11 above the louver unit 10.

Figure 4:
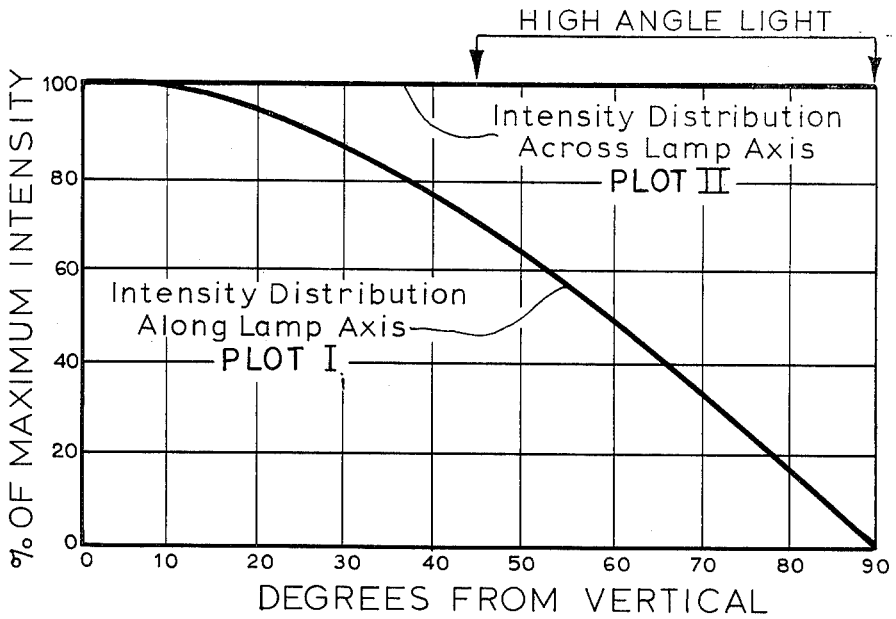
FIG. 4 is a graph illustrating light intensity distribution across the lamp axis as related to light intensity distribution along the lamp axis, without the use of a louver unit.

As will be seen, the longitudinal axis of the lamp tube 11 extends parallel to the longitudinal or Y-axis of the louver unit 10. Referring to FIG. 4, the tube 11 emits light rays whose intensity remains substantially constant transversely of the lamp tube 11, regardless of whether the light source is viewed vertically from below or at any position to one or the other side of the tube; i.e., at an angle of 0° to 90° to the vertical.

On the other hand, it will also be seen that with such a lamp, when viewed in the longitudinal plane of the tube, maximum light intensity still obtains as long as one is directly below it, but as the viewing angle goes from up (0°) to the vertical toward horizontal (90° to the vertical), the light intensity decreases until at 90° to the vertical there is a zero percent (0°) of the maximum intensity of light rays visible.

Figure 2:
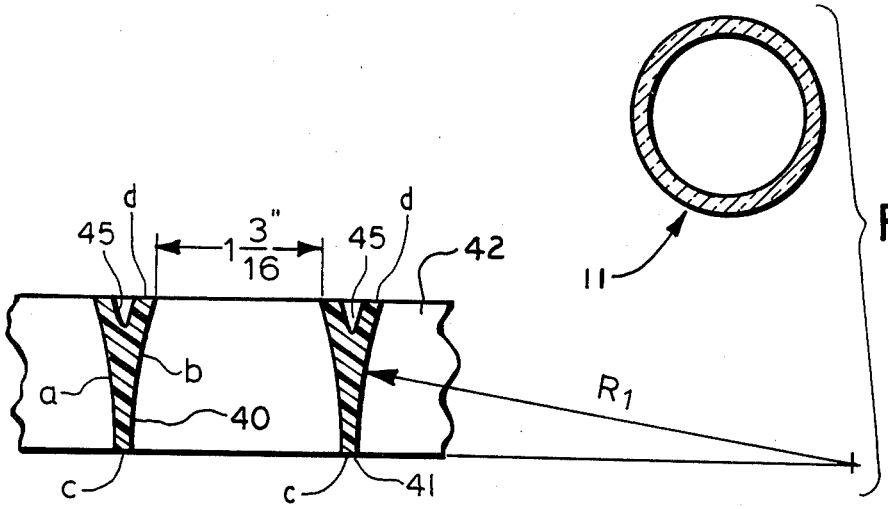
FIG. 2 is a sectional view taken along line 2—2 of FIG. 1.
Figure 3:
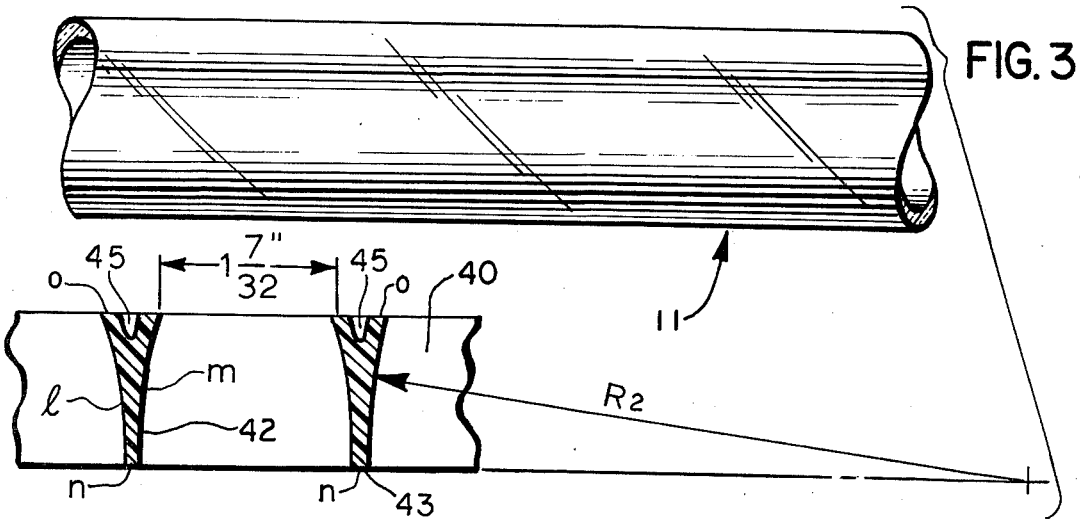
FIG. 3 is a sectional view taken along line 3—3 of FIG. 1.

The louver unit 10 embodying features of the present invention affects the light output of the source 11 in such a manner that virtually uniform light effect is obtained regardless of which direction the viewer looks at the louver unit from and regardless of what angle from the vertical the unit is viewed from. Reference is now made to FIGS. 2 and 3 of the drawings where the details of construction of the louver unit which produce this effect are illustrated.

FIG. 2 is a sectional view taken along line 2—2 of FIG. 1. As such, it is a vertical section through the louver unit 10 on a plane which extends perpendicular to the axis of the lamp 11. The view illustrates vertical blades 40 and 41 in section and vertical blade 42 in front elevation. The vertical blade 42 also extends perpendicular to the lamp 11, while the vertical blades 40 and 41 extend parallel to the lamp.

The vertical blades 40, 41, 42 and 43 (see FIGS. 1 and 3 for blade 43) define the opening or cell 25 hereinbefore referred to. The unit 10 is, of course, unitarily formed of many such cells 25 defined by corresponding blades.

The unit 10 is molded from plastic in a single piece, as has been pointed out. Looking at the plastic blades 40 and 41, it will be seen that the opposite side surfaces *a* and *b* of each curve upwardly and outwardly from the lower surface *c* of the blade to the upper surface *d* thereof. As a result, adjacent their lower surfaces *c* the blades 40 and 41 are relatively narrow while adjacent their upper surfaces *d* the same blades are relatively wide.

The radii of curvature of the opposite side surfaces *a* and *b* on each blade are identical. In the illustration that radius of curvature $R_1$ is 3 3/5 inches. At their upper surfaces *d* the opposed curved side surfaces *a* and *b* in each cell are 1 3/16 inches apart.

Referring now to FIG. 3, the blades 42 and 43 also have curved side surfaces *l* and *m*. These side surfaces *l* and *m* curve upwardly and outwardly from the lower surfaces *n* of corresponding blades to the upper surfaces *o* of these blades. As such, the lower surfaces *n* are correspondingly narrow while the upper surfaces *o* are correspondingly wide.

The upper surfaces *d* and *o* have Vee-shaped depressions 45 formed therein in the molding process. These depressions 45 reduce the amount of plastic needed to a unit and eliminate possible sink marks caused when injection molding the product.

The radius $R_2$ of curvature of each of the side surfaces *l* and *m* on both blades 42 and 43 is, in the present illustration, 4¾ inches. As will be recognized, it is substantially greater than the radius $R_1$. At the upper surface *o* the opposed curved sides *l* and *m* are 1 7/32 inches apart. This distance is greater than that between blades *a* and *b*.

The side surfaces *a* and *b* of the blades 40 and 41 have a smaller radius of curvature and, thus, are more "curved" than the side surfaces *l* and *m* of the blades 42 and 43. The surfaces *a* and *b* extend parallel to the axis of the fluorescent tube 11, and, accordingly, are exposed to the maximum intensity of the light rays emitted by the tube 11 regardless of which angle to the horizontal or vertical such rays are emitted from the tube.

On the other hand, the side surfaces *l* and *m* are curved to a lesser extent. These side surfaces *l* and *m*, which lie perpendicular to the axis of the fluorescent tube 11, are exposed to lesser intensity light rays as the angle between these light rays traveling generally in the plane of the tube 11 approaches the horizontal; i.e., as it moves up on each side surface *l* and *m*.

Figure 5:
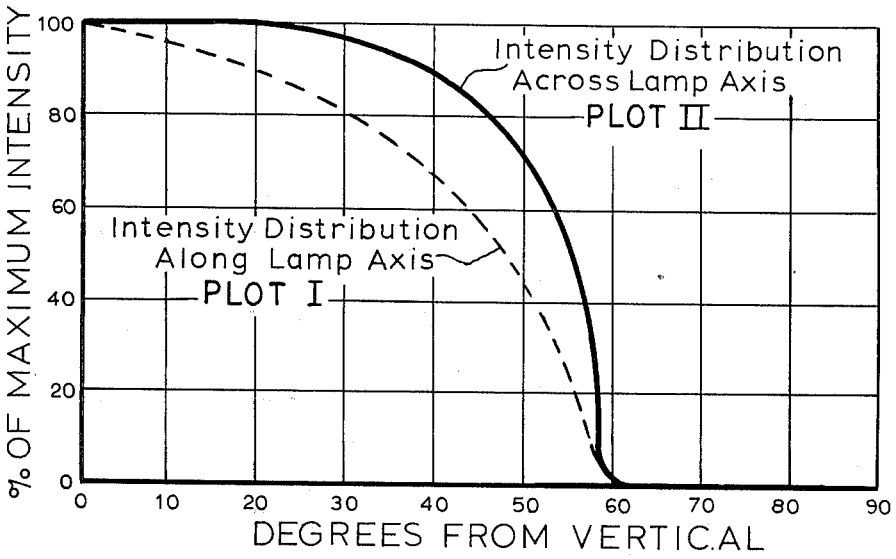
FIG. 5 is a graph illustrating light intensity distribution across the lamp axis versus light intensity distribution along the lamp axis using conventional louver units.

Turning now to FIG. 4, it illustrates the distribution of intensity of light rays emitted by a lamp (tube 11) of non-spherical construction, for a vertical plane through a longitudinal axis of the lamp (Plot I) and for a vertical plane transverse of the axis of the lamp (Plot II). It can be seen that the intensity transverse of the lamp axis is essentially constant at all vertical angles while the intensity longitudinal of the lamp axis decreases as the vertical angle increases. Thus, an unscreened lamp of this type will create a greater glare sensation when viewed across the axis than when viewed along the axis.

Where a louver unit of conventional construction is employed; i.e., where the louver blades are of identical curved side surface configuration, a new intensity distribution will be created as illustrated in FIG. 5. It is apparent from FIG. 5 that the intensity of high angle light emitted in the longitudinal plane is substantially less than that emitted in the transverse plane, this being the result of the inherent intensity distribution characteristics of the lamp. The more critical glare condition therefor exists in the transverse light distribution and in conventional louver units th design of the blades is such that the transverse light is depressed sufficiently in its vertical angle so that glare is not created. This requires a relatively small radius of curvature of the louver unit blades.

In conventional units the same radius side surfaces are formed on the blades which control the longitudinal distribution of light as for the longitudinal blades which control transverse distribution of light. This creates a depression of high angle rays in the longitudinal plane which is unnecessarily great.

The louver unit 10 described herein uses the principal of dissimilar radii for the side surfaces of the transverse and longitudinal plane blades. The transverse blades 42 and 43 are designed with side surfaces *l* and *m* having a larger radius of curvature than the side surfaces *a* and *b* of the longitudinal blades 40 and 41. As a result, the output of light in the longitudinal plane becomes more nearly equal to that in the transverse plane.

Figure 6:
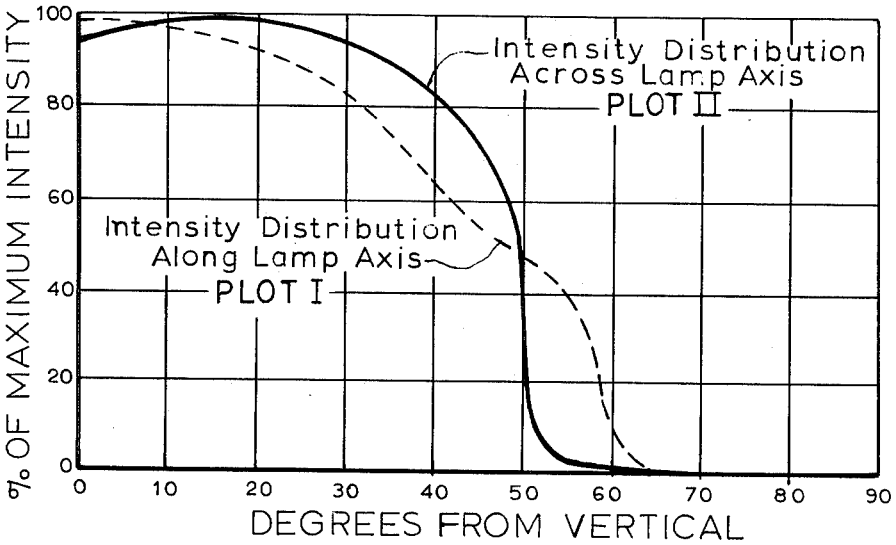
FIG. 6 is a graph illustrating light intensity distribution across a lamp axis versus light intensity distribution along the lamp axis wherein a louver unit embodying features of the invention is employed.

Consequently, the appearance of lighting systems constructed according to the invention is similar whether viewed from a transverse or longitudinal plane. FIG. 6 illustrates the distribution of light ray intensity where a louver unit 10 is used. An improved appearance is seen in lighting installations where fixtures are used for both transverse and longitudinal planes.

Furthermore, the open area at the top of each louver cell 25 is increased. As the radius $R_2$ exceeds the radius $R_1$ the open area at the top of the cell increases. As a result, useful light output is increased since there is a larger opening for the light to pass through.

By the same reasoning, the cross-sectional area of the louver blade resulting from the use of radius $R_2$ will be less than that of the louver blades designed using the radius $R_1$. Thus, a substantially reduced amount of plastic material is required for the construction of this louver unit versus conventional louver units.

While the embodiment described herein is at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. In a lighting fixture assembly including an elongated lamp surmounting a louver unit which has first vertically orientated blades extending longitudinally of the axis of the elongated lamp and second vertically orientated blades extending transversely of the axis of the elongated lamp whereby said blades form a plurality of cells between opposed side surfaces of said blades and the cells are open from the upper surfaces of the blades to the lower surfaces thereof, the improvement comprising:

a. in at least a substantial majority of the cells, the opposed side surfaces on said first blades each having at least a portion thereof curved about a horizontal axis, b. in said cells the opposed side surfaces on said second blades each having at least a portion thereof curved about a horizontal axis, c. the radius of curvature of said curved surface portion on each of said first longitudinally extending blades being smaller than the radius of curvature of said surface portion on each of said second transversely extending blades whereby light rays emitted from said elongated lamp longitudinally thereof strike said second transversely extending blades and are reflected at a greater angle to the vertical than light which is emitted transversely of said elongated lamp and strikes said side surfaces of said first longitudinally extending blades to provide a substantially uniform light effect.

2. The improvement in a lighting fixture of claim 1 further characterized in that:

a. the opposed side surfaces on both said first blades and said second blades being curved about a corresponding horizontal axis along their entire vertical lengths.

3. The improvement in a lighting fixture of claim 2 further characterized in that:

a. said longitudinally extending blades and said transversely extending blades being spaced equidistant from each other at their centerlines.

4. The improvement in a lighting fixture of claim 2 further characterized in that:

a. said radius of curvature of said curved surfaces on said longitudinally extending blades being less than 4 inches while said radius of curvature of said curved surfaces on said transversely extending blades is greater than 4 inches.

* * * * *